US009748657B1

(12) United States Patent
Grimsrud et al.

(10) Patent No.: US 9,748,657 B1
(45) Date of Patent: Aug. 29, 2017

(54) CAVITY BACKED DIPOLE ANTENNA

(71) Applicant: FIRST RF Corporation, Boulder, CO (US)

(72) Inventors: Lars E. Grimsrud, Scottsdale, AZ (US); Brandon J. Aldecoa, Denver, CO (US)

(73) Assignee: FIRST RF Corp., Boulder, CO (US)

( * ) Notice: Subject to any disclaimer, the term of this patent is extended or adjusted under 35 U.S.C. 154(b) by 184 days.

(21) Appl. No.: 14/550,874

(22) Filed: Nov. 21, 2014

Related U.S. Application Data

(60) Provisional application No. 61/907,292, filed on Nov. 21, 2013.

(51) Int. Cl.
*H01Q 9/28* (2006.01)
*H01Q 9/16* (2006.01)
*H01Q 9/26* (2006.01)

(52) U.S. Cl.
CPC ..... *H01Q 9/16* (2013.01); *H01Q 9/26* (2013.01); *H01Q 9/285* (2013.01)

(58) Field of Classification Search
CPC .. H01Q 9/28; H01Q 9/16; H01Q 9/40; H01Q 1/38
USPC ..... 343/807, 795, 789, 898
See application file for complete search history.

(56) References Cited

U.S. PATENT DOCUMENTS

2009/0046019 A1* 2/2009 Sato ..... H01Q 3/44 343/702
2009/0295667 A1* 12/2009 Ma ..... H01Q 1/2225 343/795
2012/0293381 A1* 11/2012 Apostolos ..... H01Q 1/3291 343/713

* cited by examiner

*Primary Examiner* — Dameon E Levi
*Assistant Examiner* — Collin Dawkins
(74) *Attorney, Agent, or Firm* — Christopher J. Kulish

(57) ABSTRACT

The invention is directed to a cavity backed dipole antenna that has at least a reduced length relative to a reference dipole antenna at the same first frequency of operation and, in some embodiments, an improved bandwidth relative to a reference dipole antenna. In one embodiment, the cavity backed dipole antenna comprises a driven bowtie dipole antenna and a parasitic folded sheet dipole antenna with the driven bowtie dipole antenna located with a boundary defined by the parasitic folded sheet dipole antenna.

13 Claims, 11 Drawing Sheets

CAVITY BACKED DIPOLE ANTENNA

FIELD OF THE INVENTION

The invention relates to antennas and, more specifically, to an antenna comprised of a dipole antenna and a parasitic folded dipole antenna.

BACKGROUND OF THE INVENTION

With reference to FIG. 1A, one type of dipole antenna 20 is a wire dipole comprised of first and second collinear wire/rod elements 22A, 22B that are separated from one another by a gap 24. The first element 22A extends from a first outer end 26A to a first inner end 28A. Similarly, the second element 22B extends from a second outer end 26B to a second inner end 28B. The feed points of the antenna 20 are at or very near the first and second inner ends 28A, 28B.

The dipole antenna 20 exhibits an impedance bandwidth, i.e., a frequency range over which the antenna is effectively operational. The impedance bandwidth of an antenna is typically defined as the ratio of the high frequency ($f_{ihigh}$) to the low frequency ($f_{ilow}$) at which the power output of the antenna has a voltage-standing-wave ratio (VSWR) of less than 3.5:1. FIG. 1B illustrates the impedance bandwidth of an embodiment of the antenna 20 being about 1.3:1 (i.e., for a high frequency of 1.7 GHz—and a low frequency of 1.3 GHz). Because the impedance bandwidth of the dipole antenna 20 is less than about 2:1, the dipole antenna 20 is considered to be a narrowband antenna. The length of the dipole antenna 20 is related to $f_{ilow}$ of the impedance bandwidth. To elaborate, the length of the dipole antenna 20 is the distance between the first outer end 26A and the second outer end 26B. This length is $\lambda_{ilow}/2$, where $\lambda_{ilow}$ is the wavelength at $f_{ilow}$. The dipole antenna 20 also exhibits a gain bandwidth that is typically defined as the difference between the high frequency ($f_{ghigh}$) and low frequency ($f_{glow}$) at which the power output of the antenna is greater than 0 dBi. An antenna with a gain bandwidth in which the ratio of the high to low frequencies is less than about 2:1 is also commonly referred to as a narrowband antenna. The dipole antenna 20 is considered to be a narrowband antenna.

With reference to FIG. 2A, a second type of dipole antenna is illustrated, namely, a bowtie dipole antenna 30. The bowtie dipole antenna 30 comprises first and second coplanar triangular-like elements 32A, 32B that are separated from one another by a gap 34. Each of the elements 32A, 32B can either be a flat metal sheet or a wire bent so as to form a triangle like shape. The first element 32A extends from a first outer end 36A to a first inner end 38A. Similarly, the second element 32B extends from a second outer end 36B to a second inner end 38B. The feed points of the antenna 30 are at or very near the first and second inner ends 38A, 38B. Like the dipole antenna 20, the bowtie dipole antenna 30 has an impedance bandwidth. FIG. 2B illustrates that the impedance bandwidth of an embodiment of the antenna 30 is greater than 6:1. In this case, $f_{ihigh}$ is at least 6 GHz and $f_{ilow}$ is about 1 GHz. Hence, the impedance bandwidth is greater than 6:1. The length of the bowtie dipole antenna 30 (i.e., the distance between the first outer end 36A and the second outer end 36B is $\lambda_{ilow}/2$, where $\lambda_{ilow}$ is the wavelength at $f_{ilow}$. The bowtie dipole antenna 30 is considered to be a broadband antenna, i.e., an antenna with both an impedance bandwidth and gain bandwidth greater than 2:1.

FIG. 4F illustrates the gain bandwidth plots for the embodiment of the cavity-backed dipole antenna and for a reference wire dipole antenna of the same length;

SUMMARY OF THE INVENTION

FIGS. 5A-5C respectively illustrate an embodiment of a cavity backed dipole antenna comprised of comprised of a driven "bowed" bowtie dipole antenna located within the boundaries of a parasitic folded and "bowed" sheet dipole antenna; and FIG. 6 is a plan view of a spade antenna.

The cavity backed dipole antenna has at least a reduced length relative to a first reference dipole antenna, i.e., an antenna of the same type of dipole antenna as the driven dipole antenna and operating at the same frequency but not associated with a parasitic folded dipole antenna in the manner of the cavity backed dipole antenna. In particular embodiments of the cavity backed dipole antenna, the length of the antenna approaches $\lambda_{ilow}/4$, i.e., approaches a 50% reduction in length relative to the first reference dipole antenna.

In other embodiments, the cavity backed dipole antenna has a reduced length and increased impedance and gain bandwidths relative to a second reference dipole antenna, i.e., an antenna of the same type of dipole antenna as the driven dipole antenna and operating at the same frequency but not associated with a parasitic folded dipole antenna in the manner of the cavity backed dipole antenna. In this regard, the reduced length can approach $\lambda_{ilow}/4$.

In one embodiment of the cavity backed dipole antenna, the driven dipole antenna is a wire dipole antenna, like dipole antenna 20. The parasitic folded dipole antenna is a wire structure that is coplanar with the wire dipole antenna and substantially encloses the wire dipole antenna but for a gap between the ends of the wire structure. A line extending between the ends of the wire structure is substantially parallel to the driven dipole antenna and has a length that is less than the length of the driven dipole antenna. This embodiment of the cavity backed dipole is capable of having a length that approaches $\lambda_{ilow}/4$ relative to a first reference dipole operating at the same frequency. In certain embodiments, a cavity backed dipole is realized that, in addition to exhibiting a reduced length, also exhibits multiple frequency bands in which the antenna is effectively operational, as shown by the antenna's impedance bandwidth plots.

In another embodiment of the cavity backed dipole antenna, the driven dipole antenna is a bowtie dipole antenna, like bowtie dipole antenna 30. The parasitic folded dipole antenna is a folded metal sheet structure that substantially encloses the bowtie dipole antenna but for a gap between the ends of the metal sheet structure. A plane extending between the ends of the metal sheet structure is substantially parallel to the bowtie antenna structure and has a length that is less than the length of the bowtie dipole antenna. This embodiment of the cavity backed dipole is capable of having a length that approaches $\lambda_{ilow}/4$ relative to a second reference dipole operating at the same frequency and an impedance bandwidth that approaches double the impedance bandwidth of a reference bowtie dipole antenna.

DETAILED DESCRIPTION

Generally, the present invention is directed to an antenna structure (referred to as a cavity backed dipole antenna) that includes a dipole antenna that is located within a boundary defined by a folded dipole antenna. In operation, the dipole antenna is fed, i.e., has locations to which an electrical transmission structure is attached. As such, the dipole antenna is referred to as the driven dipole antenna. The folded dipole antenna is not fed by an electrical transmission structure. Instead, the operation of the folded dipole antenna is dependent upon the operation of the driven dipole antenna. More specifically, the folded dipole antenna is electromagnetically coupled to the driven dipole antenna. As such, the folded dipole antenna is referred to as a parasitic folded dipole antenna.

Figure 3A:
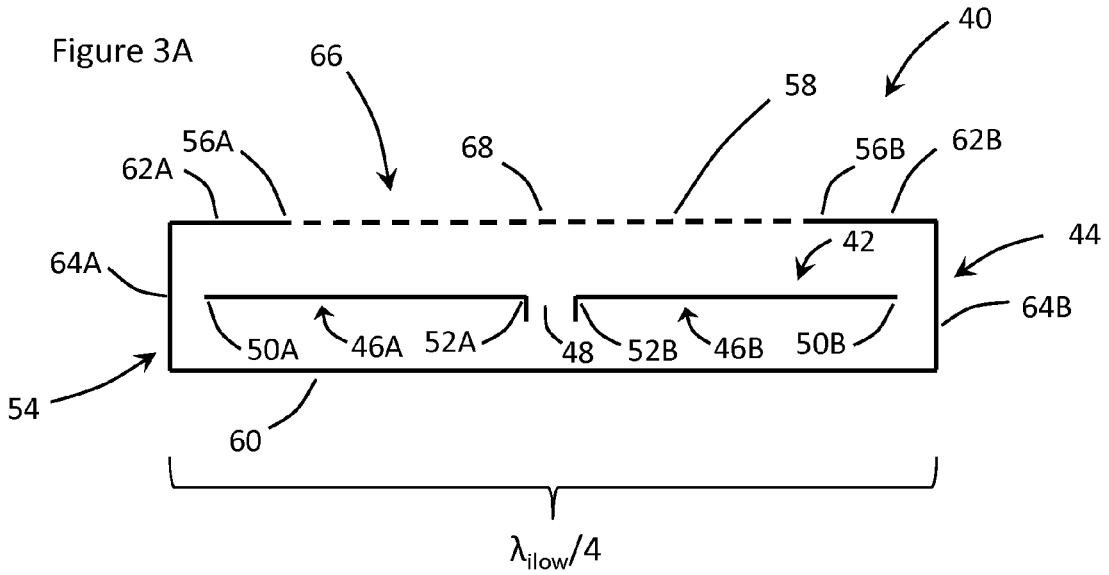
FIGS. 3A-3D respectively illustrate an embodiment of a cavity backed dipole antenna comprised of a driven wire dipole antenna located within the boundaries of a parasitic folded wire dipole antenna, a VSWR plot for the embodiment of the cavity backed dipole antenna, VSWR plots for the embodiment of the cavity backed dipole antenna and for a reference wire dipole antenna of the same length, and gain bandwidth plots for the embodiment of the cavity-backed dipole antenna and for a reference wire dipole antenna of the same length.

With reference to FIG. 3A, one embodiment of a cavity backed dipole antenna 40 is described. The antenna 40 includes a driven wire dipole antenna 42 and a parasitic folded wire dipole antenna 44. The driven wire dipole antenna 42 comprises first and second collinear wire/rod elements 46A, 46B that are separated from one another by a gap 48. The first element 46A extends from a first outer end 50A to a first inner end 52A. Similarly, the second element 46B extends from a second outer end 50B to a second inner end 52B. The length of the fed wire dipole antenna is the distance between the first and second outer ends 50A, 50B. In the illustrated embodiment, the lengths of the first and second elements 46A, 46A (i.e., the distances between the outer and inner ends of each element) are substantially equal. A wire dipole with the first and second elements having different lengths (i.e., an offset dipole) is feasible. The feed points of the fed wire dipole antenna 42 are located at or near the first and second inner ends 52A, 52B.

Figure 1A:
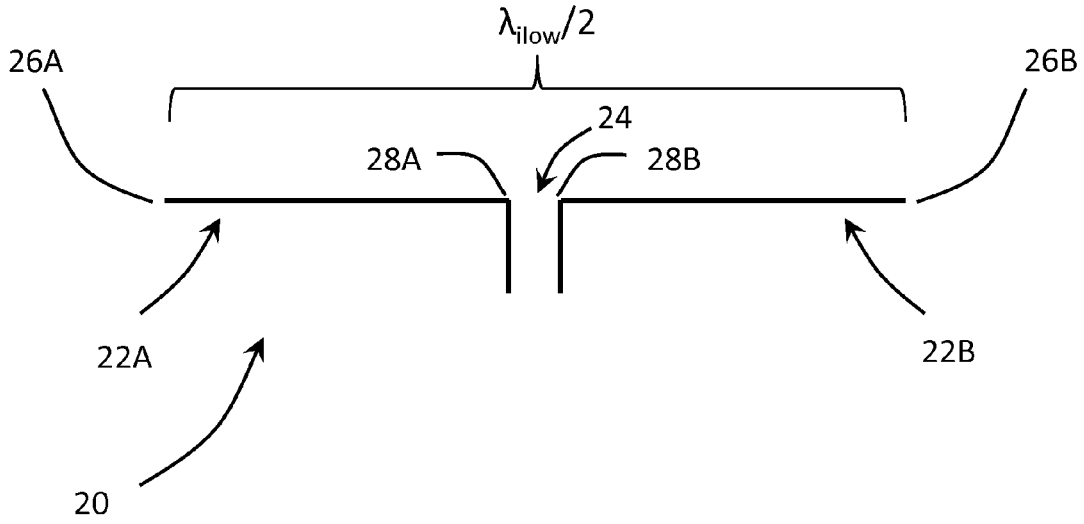
FIGS. 1A and 1B respectively illustrate a wire dipole antenna and a VSWR plot for an embodiment of the antenna.
Figure 1B:
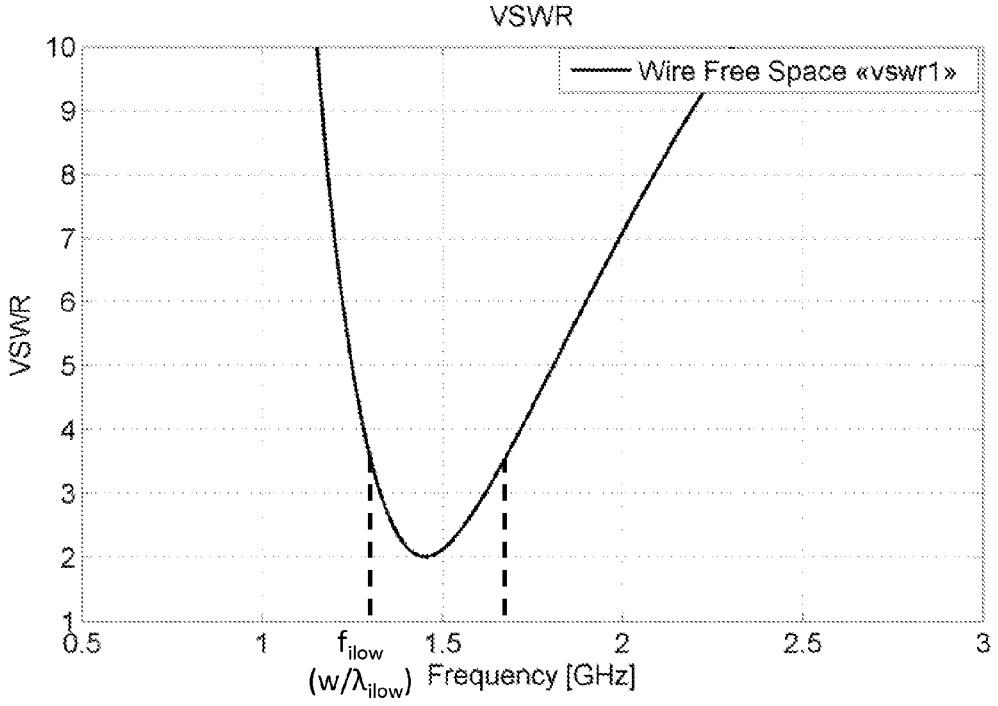
Figure 2A:
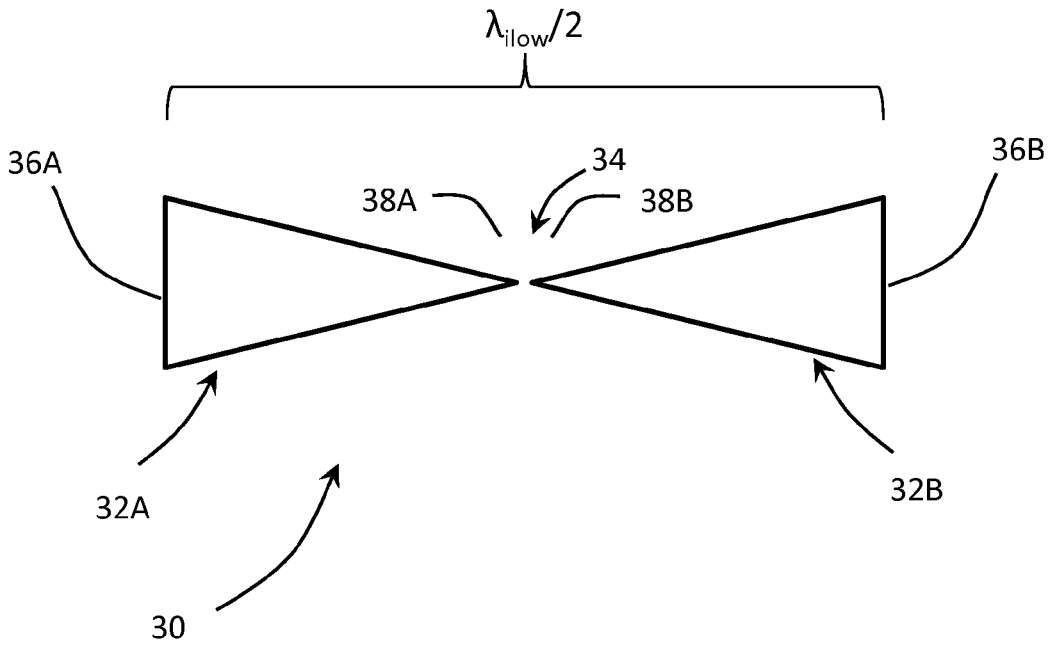
FIGS. 2A and 2B respectively illustrate a bowtie dipole antenna and a VSWR plot for an embodiment of the antenna.
Figure 2B:
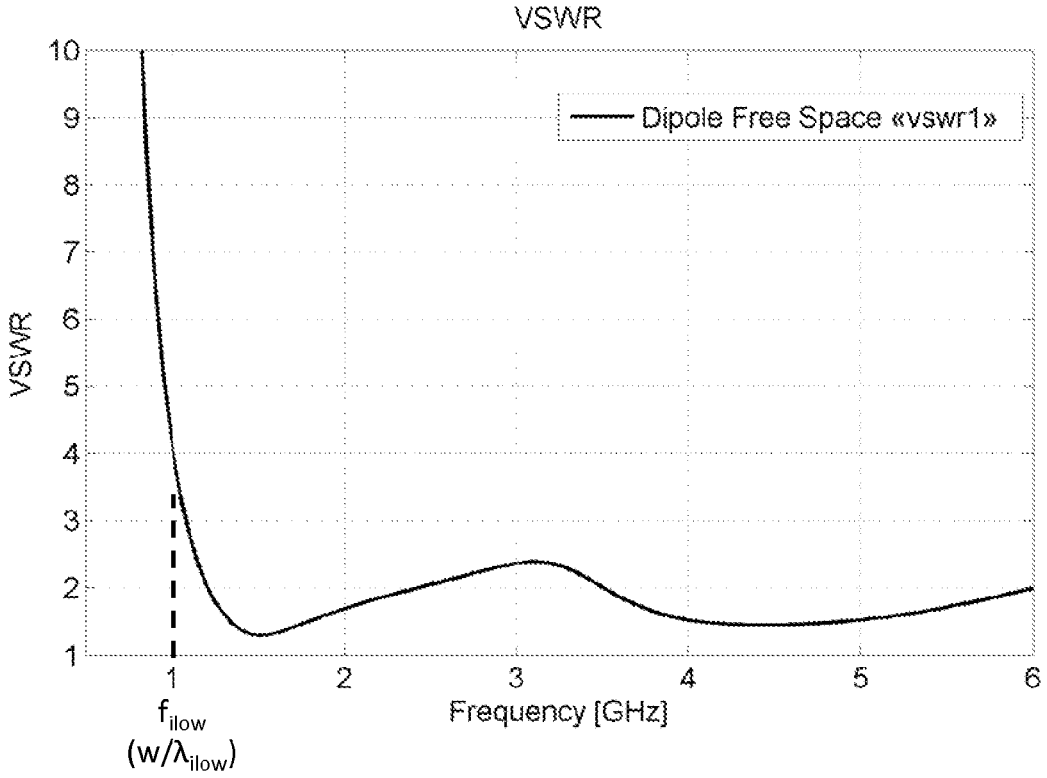
Figure 3B:
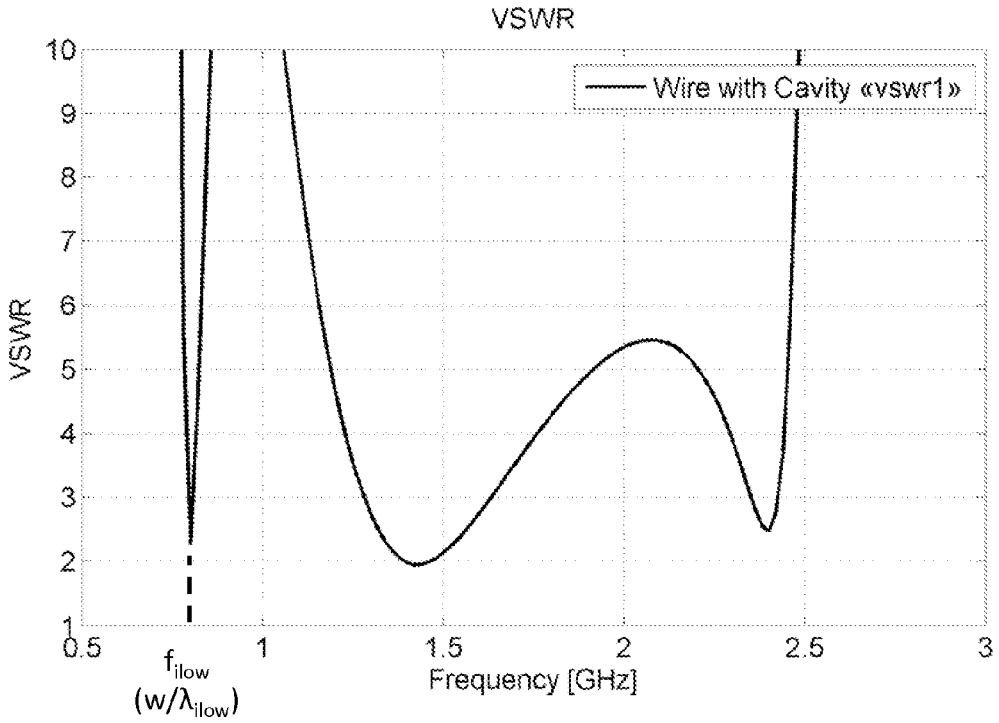

The parasitic folded wire dipole antenna 44 comprises a wire 54 that extends from a first end 56A to a second end 56B that is separated from the first end 56A so as to define a gap 58. The wire 54 comprises a base segment 60, a pair of gap segments 62A, 62B, and a pair of side segments 64A, 64B that respectively extend between the base segment 60 and the gap segments 62A, 62B. The length of the gap 58 (i.e., the distance between the first and second ends 56A, 56B) is less than the length of the fed wire dipole antenna 42. The length of the base segment 60 or the distance between the pair of side segments 64A, 64B defines the length of the parasitic folded wire dipole antenna 44, as well as the length of the cavity backed dipole antenna 40. In this case, the length of the antenna 40 (and antenna 44) is less than $\lambda_{ilow}/2$ and approaches $\lambda_{ilow}/4$ of a first reference wire dipole antenna, i.e., a dipole antenna like that illustrated in FIG. 1 and operating at the same frequency. With reference to FIGS. 3A and 3B, the length of each of the gap segments 62A, 62B is approximately $\lambda_{ilow}/20$, where $\lambda_{ilow}$ is first frequency of operation of the antenna 40 (See FIG. 3B). The gap segments 62A, 62B each have lengths in the range of $\lambda_{ilow}/10$ to $\lambda_{ilow}/20$ of the first frequency of operation. Additionally, in certain embodiments, the gap segments 62A, 62B have different lengths, which results in an uncentered gap 58. In the illustrated embodiment, the distances between (a) the gap segment 62A and the base segment 60 and (b) the gap segment 62B and the base segment are each $\lambda_{ilow}/20$, where $\lambda_{ilow}$ is first frequency of operation. These distances can each be in the range of $\lambda_{ilow}/15$ to $\lambda_{ilow}/30$ of where $\lambda_{ilow}$ is first frequency of operation. In addition, in certain embodiments, these distances can be different. In the illustrated embodiment, these distances are also the lengths of the side segments 64A, 64B, due to the side segments extending perpendicular to the base segment 60. Side segments that do not extend perpendicular to the base segment 60 and that are not linear over their entire extents are feasible.

The antenna 44 defines a boundary 66 that comprises the wire 54 and a straight line 68 that extends between the first and second ends 56A, 56B of the wire and across the gap 58. The boundary 66 has a rectangular shape. Other shapes are believed to be feasible. With respect to such other shapes, the length of the antenna 40 is the greatest interior dimension of the parasitic folded wire dipole antenna that is parallel to the driven wire dipole antenna. Notably, as the distances between (a) the first element 46A and the gap segment 62A and (b) the second element 46B and the gap segment 62B become increasing different, the shape of the boundary defined by the parasitic folded wire dipole antenna 44 and the straight line 68 that spans the gap 58 changes from being box-like to being an irregular six-sided polygon.

The driven wire dipole antenna 42 is located within the boundary 66 of defined by the parasitic folded wire dipole antenna 44. Further, the driven wire dipole antenna 42 and the parasitic folded wire dipole antenna 44 lie in substantially the same plane. The driven wire dipole antenna 42 is also disposed so as to be substantially parallel to the base segment 60 of the folded wire parasitic antenna 44 and each of the gap segments 62A, 62B.

In the illustrated embodiment, the distances between: (a) the first element 46A and the first gap segment 62A, (b) the second element 46B and the gap segment 62B and (c) the first and second elements 46A, 46B and the base segment 60 are substantially equal to one another and are about 0.5 of the distance between the first and second gap segments 62A, 62B and the base segment 60. However, these distances do not necessarily need to be substantially equal to one another. To elaborate, the distance between the first element 46A and the gap segment 62A can be 0.5 to 0.2 of the distance between the gap segment 62A and the base segment 60. As such, the distance between the first element 46A and the base segment 60 can be 0.5 to 0.8 of the distance between the gap segment 62A and the base segment 60. If the distances between (a) the first gap segment 62A and the base segment 60 and (b) the second gap segment 62B and the base segment 60 are different, the lesser distance determines the range of distances over which the relevant one of the first and second elements 46A, 46B can be spaced from the base segment 60.

The distances between (a) the first outer end 50A of the first element 46A and the side segment 64A and (b) the second outer end 50B of the second element 46B and the side segment 64B are substantially equal. However, these distances do not necessarily need to be equal. Further, these distances depend on the length of the wire dipole antenna 42. The range of lengths for the wire dipole antenna 42 extends from about $\lambda_{ilow}/8$ to slightly less than $\lambda_{ilow}/4$, where $\lambda_{ilow}$ is first frequency of operation of the antenna 40 (i.e., the antenna 42 cannot be so long that the dipole antenna contacts either of the side segments 64A, 64B).

Figure 3C:
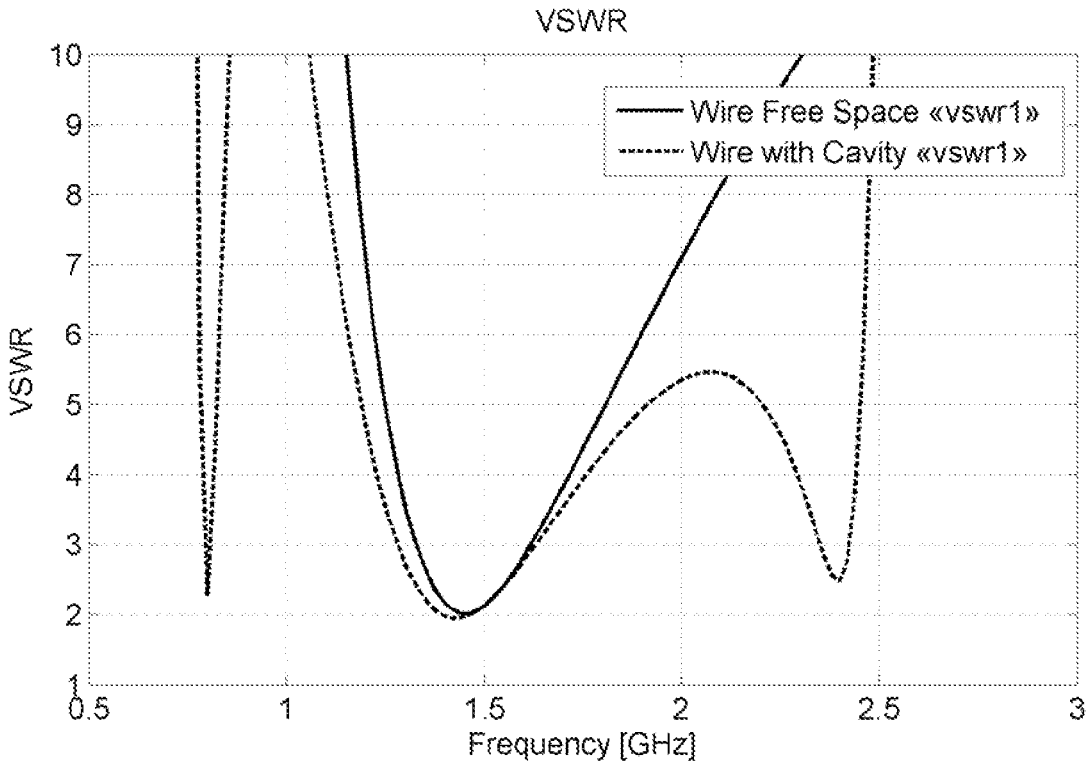
Figure 3D:
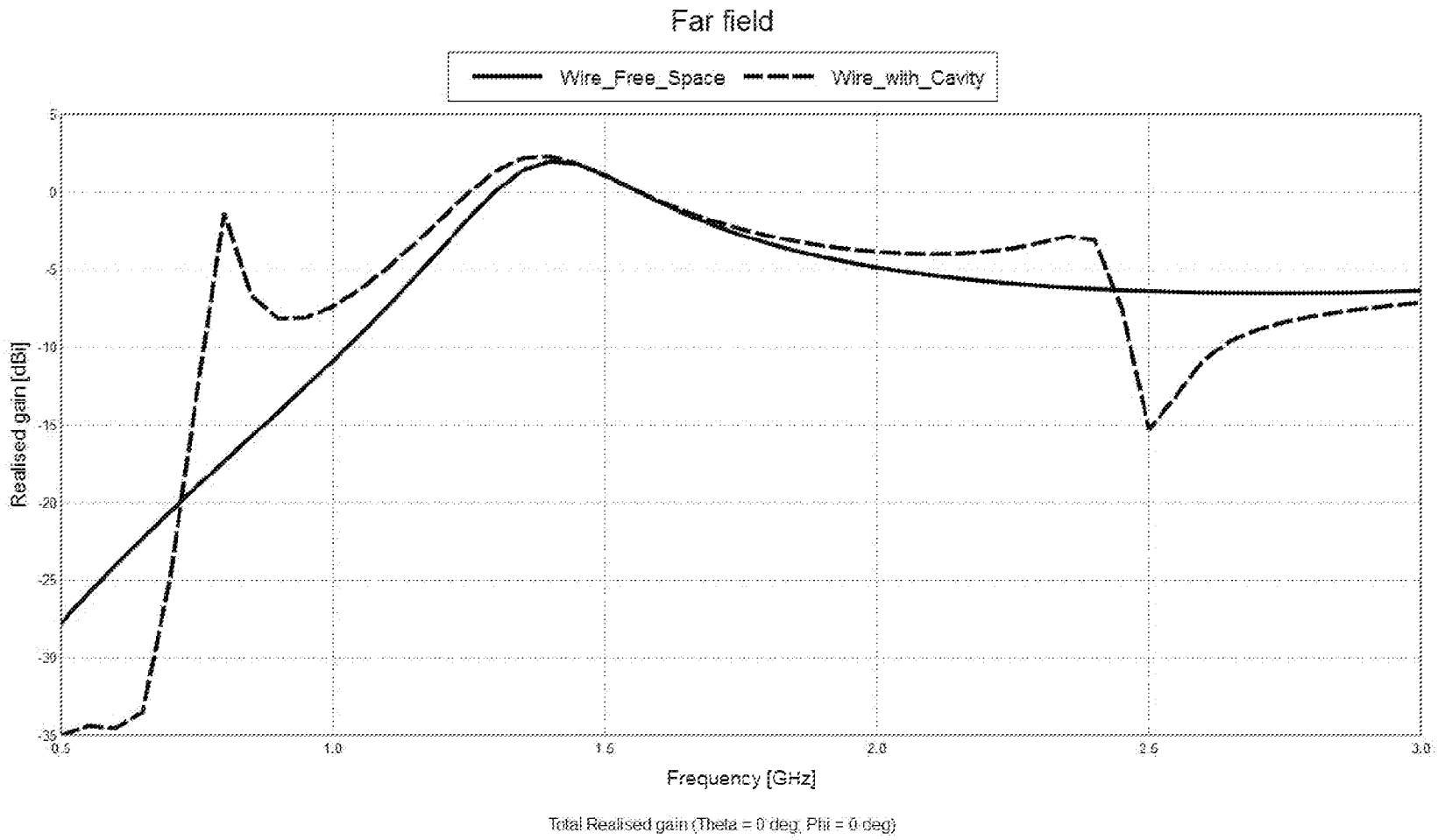

With reference to FIG. 3B, the voltage-standing-wave ratio versus frequency is plotted for the embodiment of the cavity backed dipole antenna 40. The plot shows that the first frequency of operation of the antenna 40 is $f_{ilow}$, which has a wavelength of $\lambda_{ilow}$. FIG. 3C plots the VSWR versus frequency for the antenna 40 (dashed line) and the VSWR versus frequency for the antenna 20 (solid line), which is a first reference antenna of the same length as antenna 40. The plots show that the antenna 40 has a first frequency range of operation around 0.8 GHz, which is approaching one-half of the first frequency of operation of the reference antenna 20 with the same length as antenna 40. This, in turn, implies that the length of the reference antenna 20 can be reduced by an amount that approaches $\lambda_{ilow}/4$ by the addition of a parasitic folded wire dipole antenna for antennas at the same first frequency of operation. The plot also indicates that the antenna 40 also has a second frequency range of operation around 1.4 GHz, just as with the dipole antenna 20 of the same length as antenna 40. Additionally, the antenna 40 has a third frequency range of operation around 2.4 GHz. With reference to FIG. 3D, the gain of the antenna 40 versus frequency is plotted (dashed line) and the gain of the antenna 20 versus frequency is plotted (solid line). A comparison of the two plots indicates that the antenna 40 has a greater gain bandwidth than the antenna 20.

Figure 4A:
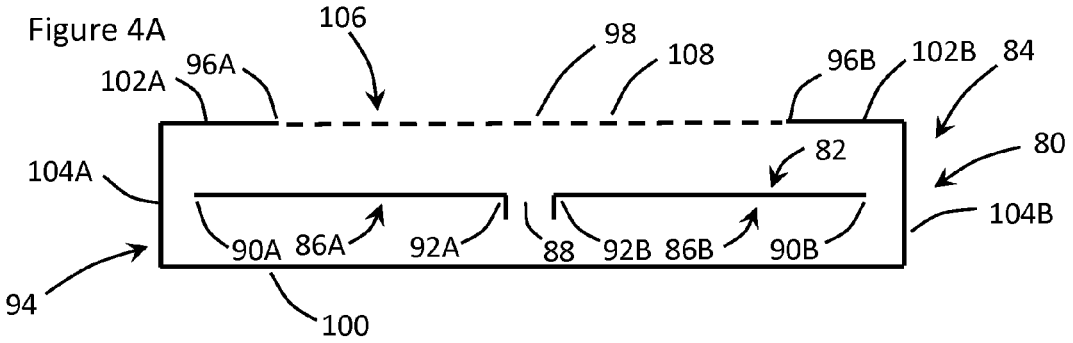
FIGS. 4A-4C respectively illustrate side, plan, and perspective views of an embodiment of a cavity backed dipole antenna comprised of a driven bowtie dipole antenna located within the boundaries of a parasitic folded sheet dipole antenna.
Figure 4B:
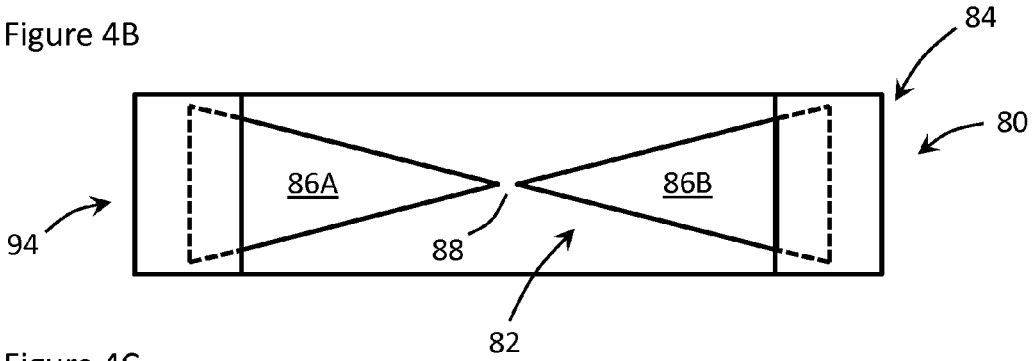
Figure 4C:
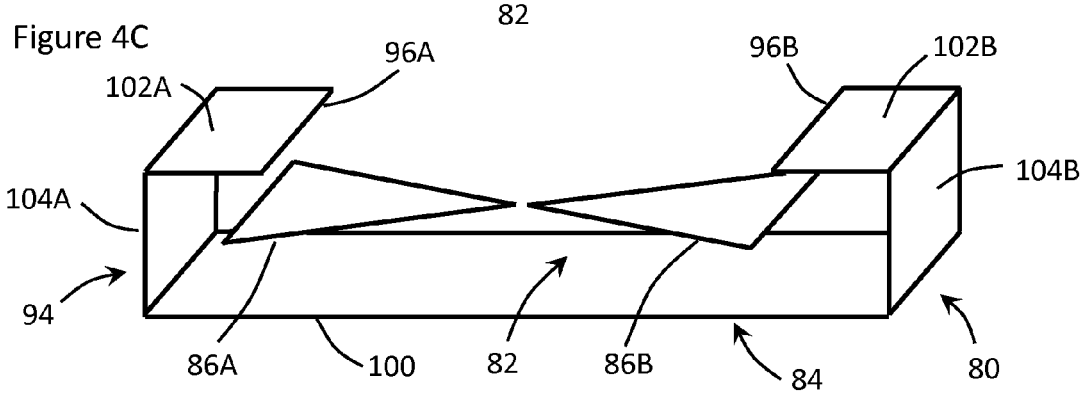

With reference to FIG. 4A-4C, a second embodiment of a cavity backed dipole antenna 80 is described. The antenna 80 includes a driven bowtie dipole antenna 82 and a parasitic folded sheet dipole antenna 84. The driven bowtie dipole antenna 82 comprises first and second coplanar triangular-like elements 86A, 86B that are separated from one another by a gap 88. The first element 86A extends from a first outer end 90A to a first inner end 92A. Similarly, the second element 86B extends from a second outer end 90B to a second inner end 92B. The length of the driven bowtie dipole antenna 82 is the distance between the first and second outer ends 90A, 90B. In the illustrated embodiment, the lengths of the first and second elements 86A, 86A (i.e., the distances between the outer and inner ends of each element) are substantially equal. A wire dipole with the first and second elements having different lengths (i.e., an offset dipole) is feasible. The feed points of the driven bowtie dipole antenna 82 are located at or near the first and second inner ends 92A, 92B.

The parasitic folded sheet dipole antenna 84 comprises a folded sheet 94 that extends from a first end 96A to a second end 96B that is separated from the first end 96A so as to define a gap 98. The folded sheet 94 comprises a base segment 100, a pair of gap segments 102A, 102B, and a pair of side segments 104A, 104B that respectively extend between the base segment 100 and the gap segments 102A, 102B. The length of the gap 98 (i.e., the distance between the first and second ends 96A, 96B) is less than the length of the driven bowtie dipole antenna 82. The length of the base segment 100 or the distance between the pair of side segments 104A, 104B defines the length of the parasitic folded sheet dipole antenna 84, as well as the length of the cavity backed dipole antenna 80. In this case, the length of the antenna 80 (and antenna 84) is $\lambda_{ilow}/4$ of a second reference bowtie dipole antenna having same the same first frequency of operation. With reference to FIGS. 4A-4D, the length of each of the gap segments 102A, 102B and side segments 104A, 104B is approximately $\lambda_{ilow}/20$ of, where kilo, is first frequency of operation of the antenna 80 (See FIG. 4D). Each of the gap segments 102A, 102B can have a length in the range of $\lambda_{ilow}/10$ to $\lambda_{ilow}/20$ of the first frequency of operation. Additionally, in certain embodiments, the gap segments 102A, 102B have different lengths, which results in an un-centered gap 98. In the illustrated embodiment, the distances between (a) the gap segment 102A and the base segment 100 and (b) the gap segment 102B and the base segment are each $\lambda_{ilow}/20$, where $\lambda_{ilow}$ is first frequency of operation. These distances can each be in the range of $\lambda_{ilow}/15$ to $\lambda_{ilow}/30$ of where $\lambda_{ilow}$ is first frequency of operation. In addition, in certain embodiments, these distances can be different. In the illustrated embodiment, these distances are also the lengths of the side segments 104A, 104B, due to the side segments extending perpendicular to the base segment 100. Side segments that do not extend perpendicular to the base segment 100 and that are not linear over their entire extents are feasible.

The antenna 84 defines a boundary 106 that comprises the folded sheet 94 and a plane 108 that extends between the first and second ends 96A, 96B of the folded sheet 94 and across the gap 98. The boundary 106 has a box-like shape. Other shapes are believed to be feasible. With respect to such other shapes, the length of the antenna 80 is the greatest interior dimension of the parasitic folded sheet dipole antenna that is parallel to the driven bowtie dipole antenna. Notably, as the distances between (a) the first element 86A and the gap segment 102A and (b) the second element 86B and the gap segment 102B become increasing different, the shape of the boundary defined by the parasitic folded wire dipole antenna 84 and the plane 108 that spans the gap 108 changes from being box-like to being an irregular six-sided cylinder.

The driven bowtie dipole antenna 82 is located within the boundary 106 defined by the parasitic folded sheet dipole antenna 84. Further, the driven bowtie dipole antenna 82 is disposed so as to be substantially parallel to the base segment 100 of the parasitic folded sheet dipole antenna 84 and each of the gap segments 102A, 102B. A line extending through the first and second inner ends 92A, 92B of the driven bowtie dipole antenna 82 defines a longitudinal axis of the antenna 82. Similarly, a line extending between the mid-points of the first and second ends 96A, 96B of the parasitic folded sheet dipole antenna 84 defines a longitudinal axis of the antenna 84. The longitudinal axes of the antenna 82, 84 are substantially parallel to one another.

In the illustrated embodiment, the distances between: (a) the first element 86A and the first gap segment 102A, (b) the second element 86B and the gap segment 102B and (c) the first and second elements 86A, 86B and the base segment 100 are substantially equal to one another and are about 0.5 of the distance between the first and second gap segments 102A, 102B and the base segment 100. However, these distances do not necessarily need to be substantially equal to one another. To elaborate, the distance between the first element 86A and the gap segment 102A can be 0.5 to 0.2 of the distance between the gap segment 102A and the base segment 100. As such, the distance between the first element 86A and the base segment 100 can be 0.5 to 0.8 of the distance between the gap segment 102A and the base segment 100. If the distances between (a) the first gap segment 102A and the base segment 100 and (b) the second gap segment 102B and the base segment 100 are different, the lesser distance determines the range of distances over which the relevant one of the first and second elements 46A, 46B can be spaced from the base segment 60.

The distances between (a) the first outer end 90A of the first element 86A and the side segment 104A and (b) the second outer end 90B of the second element 86B and the side segment 104B are substantially equal. However, these distances do not necessarily need to be equal. Further, these distances depend on the length of the wire dipole antenna 82. The range of lengths for the wire dipole antenna 82 extends from about $\lambda_{ilow}/8$ to slightly less than $\lambda_{ilow}/4$, where $\lambda_{ilow}$ is first frequency of operation of the antenna 80 (i.e., the antenna 82 cannot be so long that the dipole antenna contacts either of the side segments 104A, 104B).

Figure 4D:
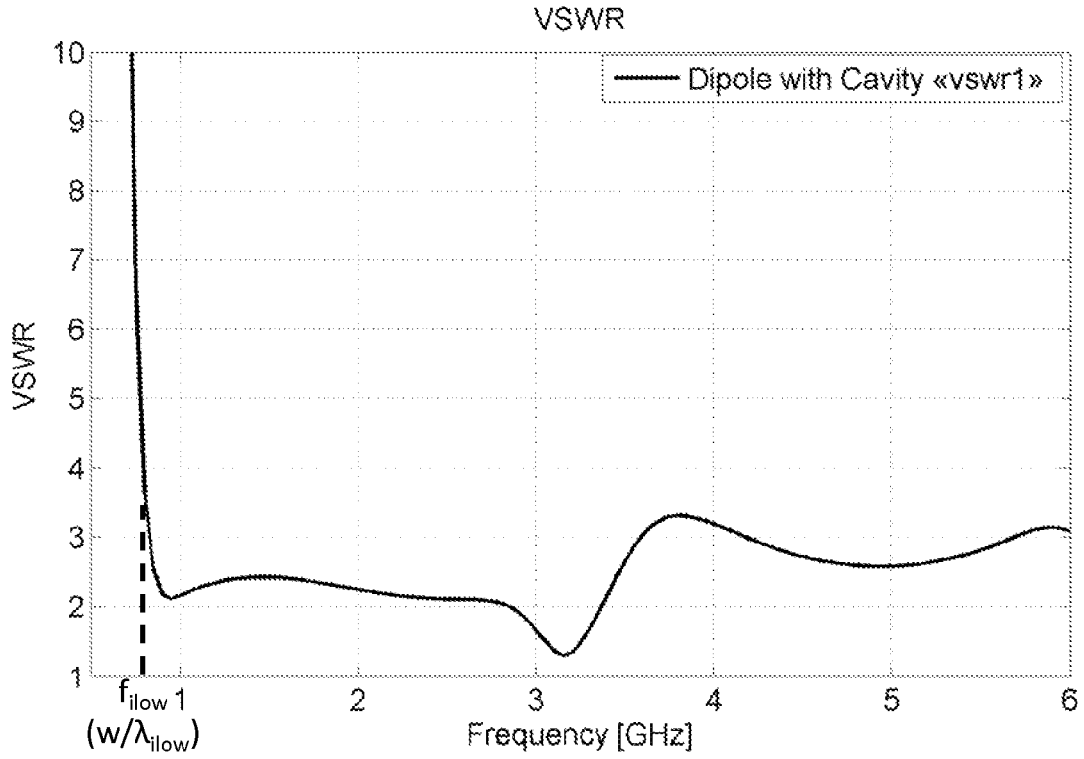
FIG. 4D illustrates a VSWR plot for the embodiment of the cavity backed antenna illustrated in FIGS. 4A-4C.
Figure 4E:
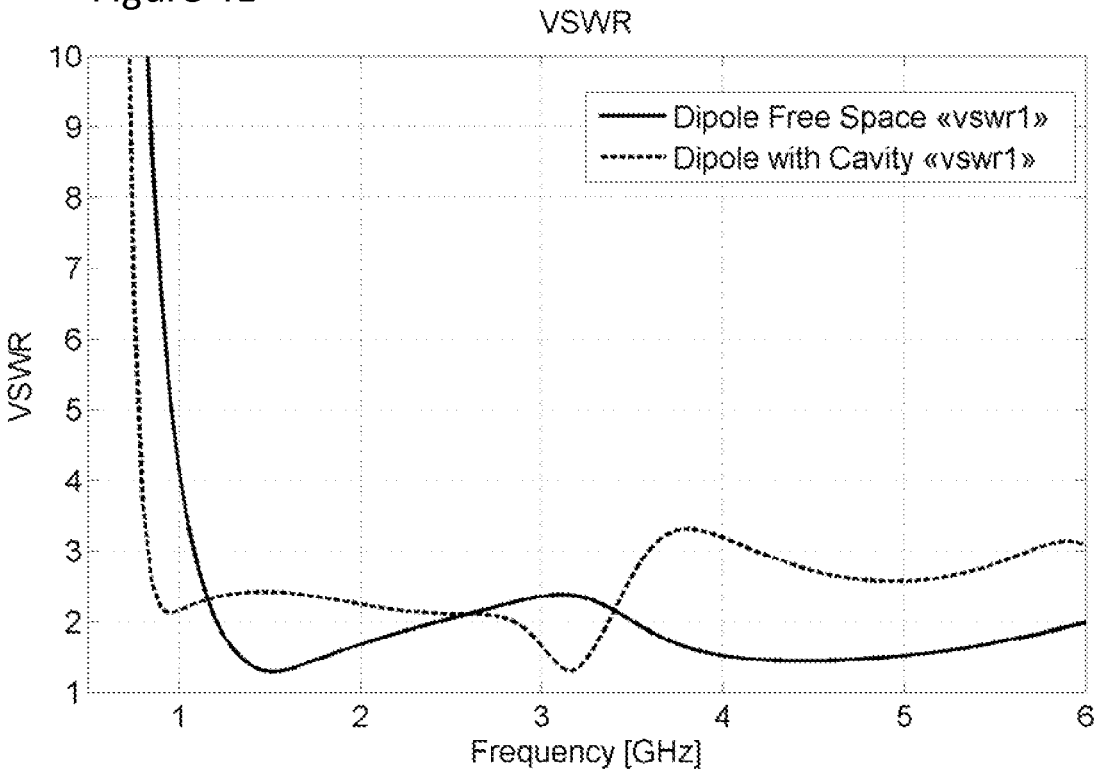
FIG. 4E illustrates the VSWR plots for the embodiment of the cavity backed dipole antenna illustrated in FIGS. 4A-4C and for a reference bowtie dipole antenna of the same length.
Figure 4F:
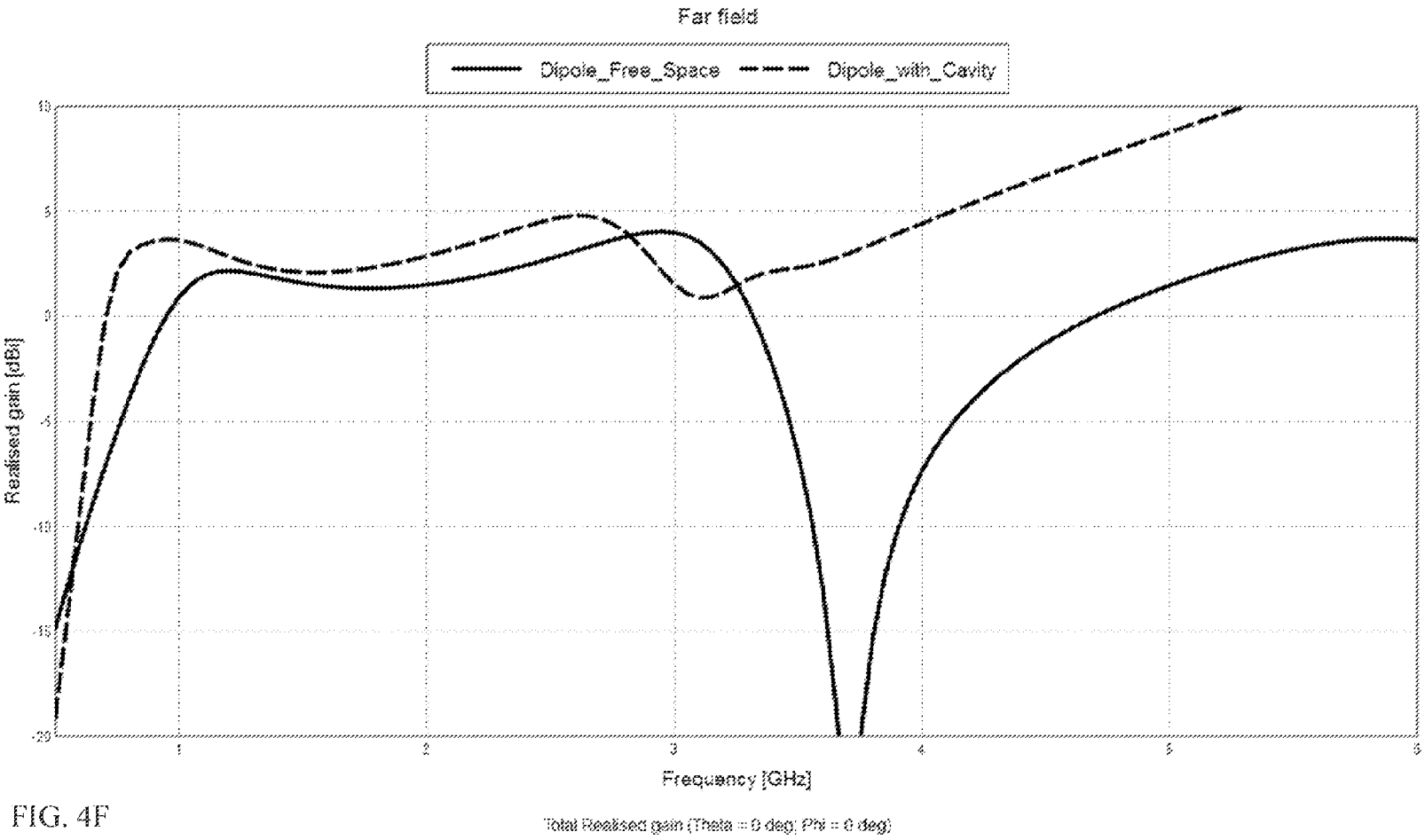
FIG. 4F illustrates the gain bandwidth plots for the embodiment of the cavity-backed dipole antenna and for a reference wire dipole antenna of the same length.

With reference to FIG. 4D, the voltage-standing-wave ratio versus frequency is plotted for the cavity backed dipole antenna 80. The plot shows that the first frequency of operation of the antenna 80 is $f_{ilow}$, which has a wavelength of $\lambda_{ilow}$. FIG. 4E plots the VSWR versus frequency for the antenna 80 (dashed line) and the VSWR versus frequency for the antenna 30 (solid line), which is a second reference antenna with the same length as antenna 80. The plots show that the antenna 80 has a first frequency of operation that is approaching one-half of the first frequency of operation of the reference antenna 30 with the same length as antenna 80. This, in turn, implies that the length of the reference antenna 30 can be reduced by an amount that approaches $\lambda_{ilow}/4$ by the addition of a parasitic folded wire dipole antenna for antennas at the same frequency of operation. The plots also show that the antenna 80 has an impedance bandwidth that is substantially better than the impedance bandwidth of the reference antenna 30 of same length as antenna 80. With reference to FIG. 4F, the gain of the antenna 80 versus frequency is plotted (dashed line) and the gain of the antenna 30 versus frequency is plotted (solid line). A comparison of the two plots indicates that the antenna 80 has a greater gain bandwidth than the antenna 30.

Figure 5A:
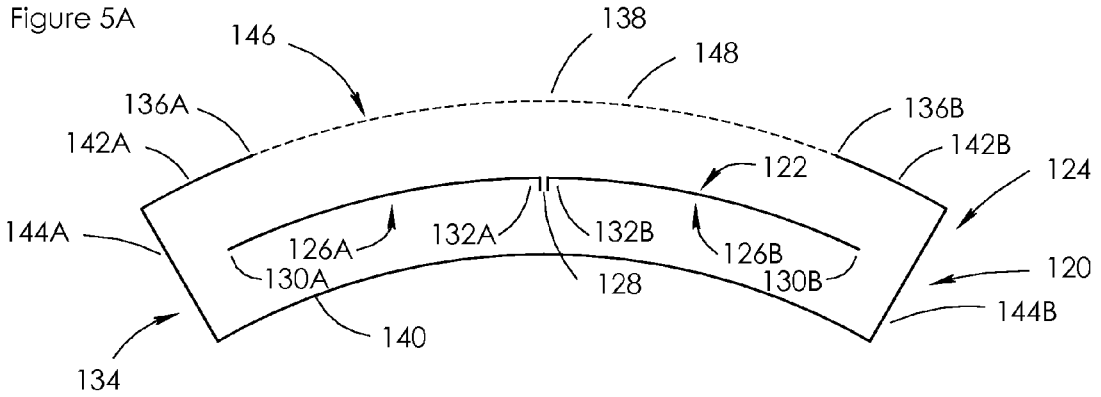
FIGS. 5A-5C respectively illustrate an embodiment of a cavity backed dipole antenna comprised of comprised of a driven "bowed" bowtie dipole antenna located within the boundaries of a parasitic folded and "bowed" sheet dipole antenna.
Figure 5B:
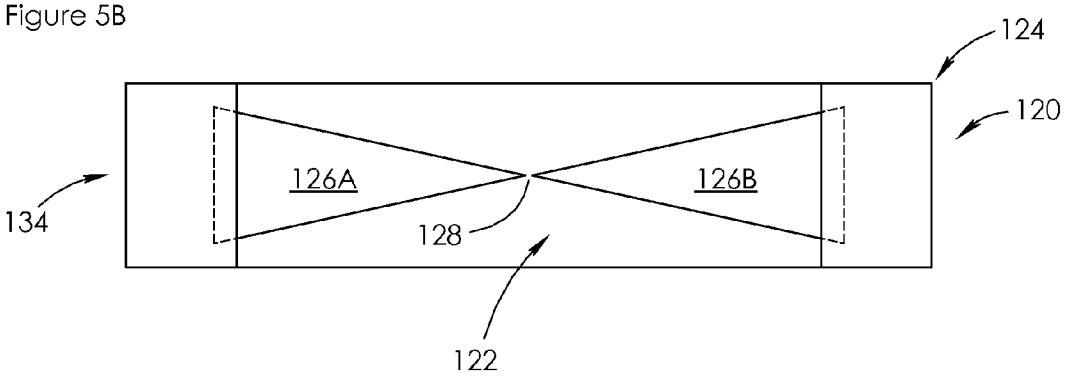
Figure 5C:
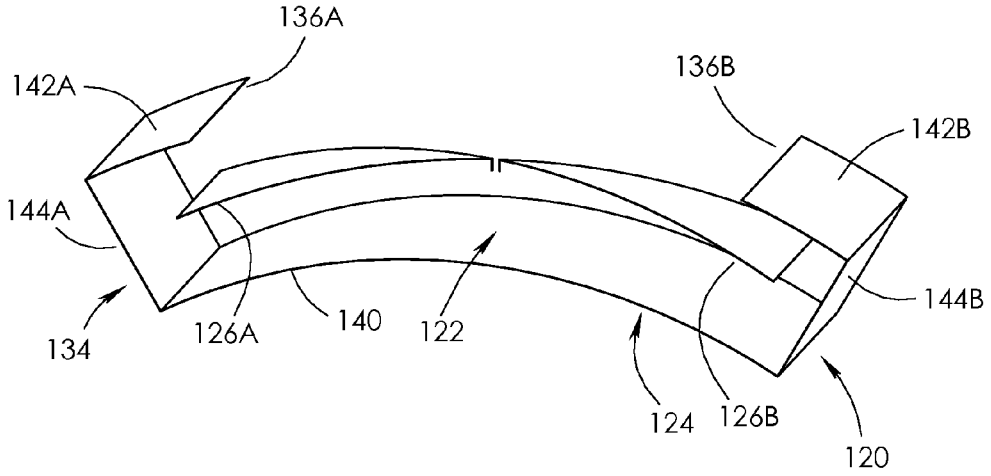

With reference to FIG. 5A-5C, a third embodiment of a cavity backed dipole antenna 120 is described. The antenna 120 includes a driven "bowed" bowtie dipole antenna 122 (sometimes referred to as "the driven bowtie dipole antenna 122") and a parasitic "bowed" folded sheet dipole antenna 124 (sometimes referred to as the "parasitic folded sheet dipole antenna 124"). The driven bowtie dipole antenna 122 comprises first and second bowed triangular-like elements 126A, 126B that each have substantially the same radius relative to a common axis and are separated from one another by a gap 128. The first element 126A extends from a first outer end 130A to a first inner end 132A. Similarly, the second element 126B extends from a second outer end 130B to a second inner end 132B. The length of the driven bowtie dipole antenna 122 is the "arc" distance between the first and second outer ends 130A, 130B. The feed points of the driven bowtie dipole antenna 122 are located at or near the first and second inner ends 132A, 132B.

The parasitic folded sheet dipole antenna 124 comprises a folded sheet 134 that extends from a first end 136A to a second end 136B that is separated from the first end 136A so as to define a gap 138. The folded sheet 134 comprises a bowed base segment 140, a pair of bowed gap segments 142A, 142B, and a pair of side segments 144A, 144B that respectively extend between the bowed base segment 140 and the gap segments 142A, 142B. The bowed gap segments 142A, 142B each have substantially the same radius relative to a common axis. The bowed base segment 140 has a radius measured relative to the same common axis as used with the bowed gap segments 142A, 142B but the radius is smaller than the radiuses of the bowed gap segments. The side segments 144A, 144B extend along radial lines extending from the common axis. The "arc" length of the gap 138 (i.e., the distance between the first and second ends 136A, 136B) is less than the "arc" length of the driven bowed bowtie dipole antenna 122. The "arc" length of the bowed base segment 140 is the "arc" distance between the pair of side segments 144A, 144B and defines the length of the parasitic folded sheet dipole antenna 124, as well as the length of the cavity backed dipole antenna 120. In this case, the length of the antenna 120 (and antenna 124) is $\lambda_{ilow}/4$ of a second reference bowtie dipole antenna of the same length. The length of each of the bowed gap segments 142A, 142B and side segments 144A, 144B is approximately $\lambda_{ilow}/20$, where $\lambda_{ilow}$ is first frequency of operation of the antenna 120. The antenna 124 defines a boundary 146 that comprises the folded sheet 134 and a portion of a cylindrical surface 148 that extends between the first and second ends 136A, 136B of the folded sheet 134 and across the gap 138. The boundary 146 has a cylindrical-box-like shape. Other shapes are believed to be feasible. With respect to such other shapes, the length of the antenna 120 is the greatest interior dimension of the parasitic folded sheet dipole antenna that is parallel to the driven bowtie dipole antenna.

The driven bowed bowtie dipole antenna 122 is located within the boundary 146 that is in part defined by the parasitic folded sheet dipole antenna 124. Further, the driven bowtie dipole antenna 122 is disposed so as to be substantially parallel (or equidistant) to the base segment 140 of the parasitic folded sheet dipole antenna 124 and each of the gap segments 142A, 142B. An "arc" line extending through the first and second inner ends 132A, 132B of the driven bowtie dipole antenna 122 defines a longitudinal axis of the antenna 122. Similarly, an "arc" line extending between the mid-points of the first and second ends 136A, 136B of the parasitic folded sheet dipole antenna 124 defines a longitudinal axis of the antenna 124. The longitudinal axes of the antenna 82, 84 are substantially parallel (equidistant) to one another.

The cavity backed dipole antenna 120 exhibits similar length and bandwidth characteristics to those noted with respect to antenna 80.

Figure 6:
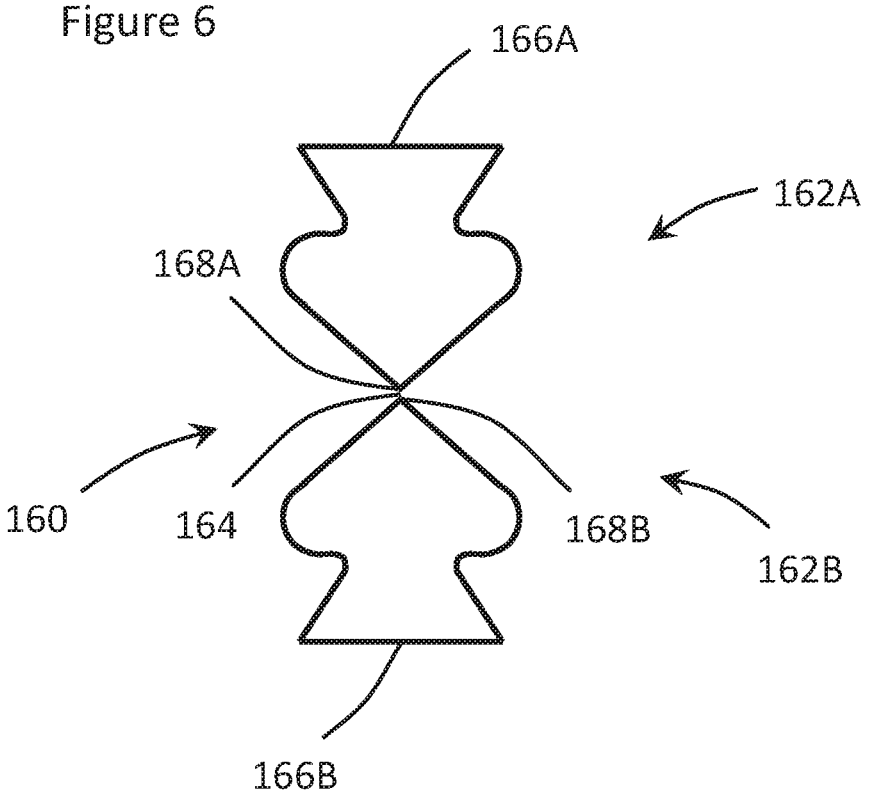

Among the other types of driven dipole antenna structures that can associated with a parasitic folded sheet dipole antenna structure is a spade antenna. FIG. 6 illustrates an embodiment of a driven spade antenna 160. The spade antenna 160 is comprised of first and second coplanar spade-like elements 162A, 162B that are separated from one another by a gap 164. The first element 162A extends from a first outer end 166A to a first inner end 168A. Similarly, the second element 162B extends from a second outer end 166B to a second inner end 168B. The length of the driven spade antenna 160 is the distance between the first and second outer ends 166A, 166B. In the illustrated embodiment, the lengths of the first and second elements 162A, 162A (i.e., the distances between the outer and inner ends of each element) are substantially equal. A driven spade antenna with the first and second elements having different lengths is feasible. The feed points of the driven spade antenna 160 are located at or near the first and second inner ends 168A, 168B. A more detailed discussion of spade antennas can be found in applicant's U.S. Pat. Nos. 9,077,075 and 9,166,283.

The foregoing description of the invention is intended to explain the best mode known of practicing the invention and to enable others skilled in the art to utilize the invention in various embodiments and with the various modifications required by their particular applications or uses of the invention.

What is claimed is:

1. An antenna structure comprising:

a driven dipole antenna structure; and a parasitic folded dipole antenna structure that partially defines an enclosed space and, in operation, is electromagnetically coupled to the driven dipole antenna;

wherein the parasitic folded dipole antenna structure comprises:

(a) a base segment that extends from a base segment first terminal end to a base segment second terminal end, (b) a first and second gap segments that each extend from a first gap segment terminal end to a second gap segment terminal end, (c) a first side segment that extends from the base segment first terminal end to the second gap segment terminal end of the first gap segment, and (d) a second side segment that extends from the base segment second terminal end to second gap segment terminal end of the second gap segment;

wherein the parasitic folded dipole antenna structure defines a gap that extends between the first gap segment terminal ends of the first and second gap segments;

wherein the base segment, first and second gap segments, first and second side segments, and a straight, imaginary line or flat, imaginary plane extending from the first gap segment terminal end of the first gap segment to the first gap segment terminal end of the second gap segment define the enclosed space;

wherein the driven dipole antenna structure is entirely located within the enclosed space defined by the parasitic folded dipole antenna structure and the straight, imaginary line or flat, imaginary plane;

wherein the driven dipole antenna structure extends from a first outer end to a second outer end of the driven dipole antenna structure and has a length $L_d$ that is measured from the first outer end to the second outer end;

wherein the gap has a length $L_g$ that is measured from the first gap segment terminal end of the first gap segment to the first gap segment terminal end of the second gap segment;

wherein the length $L_g$ is less than the length $L_d$;

wherein the parasitic folded dipole antenna has a total length $L_p$ that is the sum of the lengths of the base segment, first and second gap segments, and first and second side segments;

wherein the ratio of $L_d/L_p$ is no greater than 0.75.

2. The antenna structure, as claimed in claim 1, wherein:

the parasitic folded dipole antenna structure has a side-to-side length that is the distance between the first and second side segments;

wherein the side-to-side length is less than the length of a dipole antenna structure of the same type as the driven dipole antenna structure and operating at the same frequency as the driven dipole antenna structure in the absence of the parasitic folded dipole antenna structure.

3. The antenna structure, as claimed in claim 1, wherein:

the driven dipole antenna structure has a gain bandwidth of "x" in the absence of the parasitic folded dipole antenna structure;

the driven dipole antenna structure has a gain bandwidth of k times x in the presence of the parasitic folded dipole antenna structure, where k is greater than 1.

4. The antenna structure, as claimed in claim 1, wherein:

a portion of the driven dipole antenna structure is located between the first gap segment and the base segment of the parasitic folded dipole antenna structure.

5. The antenna structure, as claimed in claim 1, wherein:

the driven dipole antenna structure is one of: a wire dipole, a bowtie, a spade, and a folded dipole antenna structure.

6. The antenna structure, as claimed in claim 1, wherein:

the base segment of the parasitic folded dipole antenna structure is substantially parallel to the first and second gap segments of the parasitic folded dipole antenna structure.

7. The antenna structure, as claimed in claim 6, wherein:

the first and second gap segments of the parasitic folded dipole antenna structure are substantially the same distance from the base segment of the parasitic folded dipole antenna structure.

8. The antenna structure, as claimed in claim 6, wherein:

the first and second gap segments of the parasitic folded dipole antenna structure are different distances from the base segment of the parasitic folded dipole antenna structure.

9. An antenna structure comprising:

a driven bowtie antenna structure; and a parasitic folded sheet dipole antenna structure that partially defines an enclosed space and, in operation, is electromagnetically coupled to the driven bowtie antenna;

wherein the parasitic folded sheet dipole antenna extends from a first terminal end to a second terminal end and has a gap between the first and second terminal ends;

wherein the parasitic folded sheet dipole antenna and an flat, imaginary plane extending between the first and second terminal ends of the parasitic folded sheet dipole antenna defines the enclosed space;

wherein the driven bowtie antenna is entirely located in the enclosed space;

wherein the driven bowtie antenna structure extends from a first outer end to a second outer end of the driven dipole antenna structure and has a length $L_b$ that is measured from the first outer end to the second outer end;

wherein the gap extends from the first terminal end to the second terminal end and has a length $L_g$ that is measured from the first terminal end to the second terminal end of the parasitic folded sheet dipole antenna;

wherein the length $L_g$ is less than the length $L_b$;

wherein, for any line perpendicular to the driven bowtie antenna structure that intersects the parasitic folded sheet dipole antenna structure at a first point located on one side of the driven bowtie antenna structure and at a second point located on the opposite side of the driven bowtie antenna structure, the distance from the first point to the second point is no greater than $\lambda_{ilow}/15$, where $\lambda_{ilow}$ is the first frequency of operation of the antenna.

10. The antenna structure, as claimed in claim 9, wherein:

the parasitic folded sheet dipole antenna structure has a length;

wherein the length of the parasitic folded sheet dipole antenna is less than the length of a dipole antenna structure of the same type as the driven dipole antenna structure and operating at the same frequency as the driven dipole antenna structure in the absence of the parasitic folded sheet dipole antenna structure.

11. The antenna structure, as claimed in claim 9, wherein:

the driven bowtie dipole antenna structure has a gain bandwidth of "x" in the absence of the parasitic folded sheet dipole antenna structure;

the driven bowtie dipole antenna structure has a gain bandwidth of k times x in the presence of the parasitic folded sheet dipole antenna structure, where k is greater than 1.

12. The antenna structure, as claimed in claim 9, wherein:

the driven bowtie antenna structure includes a spade antenna structure.

13. The antenna structure, as claimed in claim 9, wherein:

the parasitic folded sheet dipole antenna structure has a length $L_p$ that is the length along the parasitic folded sheet dipole antenna from the first terminal end to the second terminal end;

wherein the ratio of $L_b/L_p$ is no greater than 0.75.

* * * * *